United States Patent [19]

Breckenfeld et al.

[11] 4,304,737

[45] Dec. 8, 1981

[54] CONTROL MECHANISM FOR A CARBURETOR

[75] Inventors: Paul W. Breckenfeld, Winthrop Harbor; Robert R. Wallin, Ingleside, both of Ill.

[73] Assignee: Outboard Marine Corporation, Waukegan, Ill.

[21] Appl. No.: 178,397

[22] Filed: Aug. 15, 1980

[51] Int. Cl.[3] ..... F02M 1/02

[52] U.S. Cl. ..... 261/50 R; 261/64 E; 261/71

[58] Field of Search ..... 261/50 R, 64 E, 71

[56] References Cited

U.S. PATENT DOCUMENTS

| | | | |
|---|---|---|---|
| 1,177,318 | 3/1916 | Goldberg | 261/64 E |
| 1,556,179 | 10/1925 | Titman | 261/64 E |
| 1,605,280 | 11/1926 | Rayfield | 261/64 E |
| 2,264,365 | 12/1941 | Conover | 261/71 |
| 2,744,736 | 5/1956 | Evinrude | 261/DIG. 68 |
| 2,791,207 | 5/1957 | Rayniak | 261/39 R |
| 2,951,690 | 9/1960 | Eberline | 261/71 |
| 3,275,029 | 9/1966 | Wellman | 74/502 |
| 3,309,068 | 3/1967 | Nierode | 261/DIG. 68 |
| 3,355,960 | 12/1967 | Bureck et al. | 74/504 |
| 4,001,355 | 1/1977 | Day | 261/77 |

FOREIGN PATENT DOCUMENTS

| | | | |
|---|---|---|---|
| 599584 | 10/1925 | France | 261/71 |

*Primary Examiner*—Tim R. Miles

*Attorney, Agent, or Firm*—Michael, Best & Friedrich

[57] ABSTRACT

Disclosed herein is a carburetor comprising a body including an air induction passage, a choke valve pivotally supported in the air induction passage for pivotal movement between choke open and choke closed positions, a fuel inlet valve selectively operable for controlling introduction of fuel from a source into a fuel chamber, a control member supported by the body, having an axis, and operative for movement axially along and rotationally about the axis, and a linkage opertively connecting the control member with the choke valve and the fuel inlet valve for operating the choke valve in response to axial movement of the control member between choke open and choke closed positions and for operating the fuel inlet valve in response to rotational movement of the control member, which linkage includes a rigid arm extending fixedly from the choke valve, a choke control link integrally including a body part on the control member, an end part pivotally connected to the arm, and an intermediate resilient connecting part joining the body part and the end part, and interengaging elements on the control member and on the body part for permittng relative pivotal movement between the choke control link and the control member and for providing movement of the choke control link in common with axial movement of the control member.

10 Claims, 7 Drawing Figures

CONTROL MECHANISM FOR A CARBURETOR

FIELD OF THE INVENTION

The invention generally relates to carburetors for internal combustion engines and, more particularly, to mechanisms which control choke valves and fuel valves associated with carburetors.

More particularly, the invention relates to carburetors having a control member operable to provide control of each of the carburetor fuel inlet valve and choke valve.

DESCRIPTION OF THE PRIOR ART

Attention is directed to the copending Brown et al application Ser. No. 134,129 filed Mar. 26, 1980 which discloses one form of carburetor in which a single control member is operable to regulate both a fuel inlet valve and a choke valve.

Attention is also directed to the following U.S. patents which generally disclose control mechanism utilizing a single control rod:

Wellman U.S. Pat. No. 3,275,029, Sept. 27, 1966;

Bureck et al. U.S. Pat. No. 3,355,960, Dec. 5, 1967.

SUMMARY OF THE INVENTION

The invention provides a carburetor comprising a body including means defining an air induction passage, a choke valve pivotally supported by the body in the air induction passage for movement about an axis between choke open and choke closed positions, a fuel chamber, a fuel inlet valve selectively operable for controlling introduction of fuel from a source into the fuel chamber, a control member supported by the body, having an axis, and operative for movement axially along and rotationally about the axis, and linkage means operatively connecting the control member with the choke valve and the fuel inlet valve for operating the choke valve in response to axial movement of the control member between choke open and choke closed positions and for operating the fuel inlet valve in response to rotational movement of the control member, which linkage means includes a rigid arm extending fixedly from the choke valve and radially of the axis of choke valve pivotal movement, a choke control link integrally including a body part on the control member, an end part pivotally connected to the arm, and an intermediate resilient connecting part joining the body part and the end part, and means on the control member and on the body part for permitting relative pivotal movement between the choke control link and the control member and for providing movement of the choke control link in common with axial movement of the control member.

In one embodiment of the invention, the linkage means and the choke valve are arranged such that the resilient connecting part is in relatively relaxed positions when the control member and the choke valve are in the choke open and choke closed positions and in a flexed position spaced from the relaxed positions so as to bias the control member and the choke valve toward one of the choke open and choke closed positions when the control member is located intermediate the choke open and choke closed positions.

In one embodiment of the invention, the carburetor further includes a control member support on the body, the fuel inlet means includes a rotatable valve member, and the linkage means includes a lever having therein, at one end, an aperture having an axis, means mounting the lever on the support for pivotal movement therebetween about the aperature axis and against movement of the lever axially away from the support and with the control member extending through the aperature, means on the control member and on the lever for effecting common pivotal movement of the lever with the control member and for permitting relative axial movement therebetween, and a fuel control link operatively connecting the lever to the valve member for pivoting the valve member in response to pivoting of the control member.

In one embodiment of the invention, the support is U-shaped having first and second spaced legs, the first leg forming a part of the means mounting the lever and the second leg including aperture means slideably and rotatably supporting the control member in spaced relation from the support of the control member afforded by the lever and the first leg, and the choke control link is located on the control member intermediate the first and second legs of the support.

In one embodiment of the invention, the control member comprises a shaft having an end and an axial groove extending from the end and a circumferential groove extending from the axial groove, and the means permitting relative pivotal movement between the choke control link and the control member and for providing movement of the choke control link in common with axial movement of the control member comprises the circumferential groove and a key extending from the body part of the choke control link into the circumferential groove.

Other features and advantages of the embodiments of the invention will become known by reference to the following general description, claims, and drawings.

THE DRAWINGS

Figure 1:
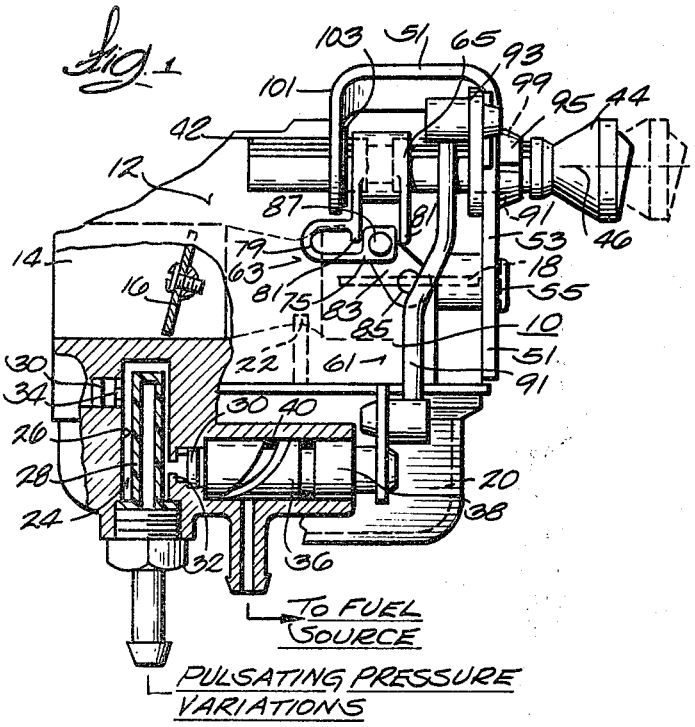
FIG. 1 is a fragmentarily and partially broken away side elevational view of a carburetor embodying various of the features of the invention.
Figure 2:
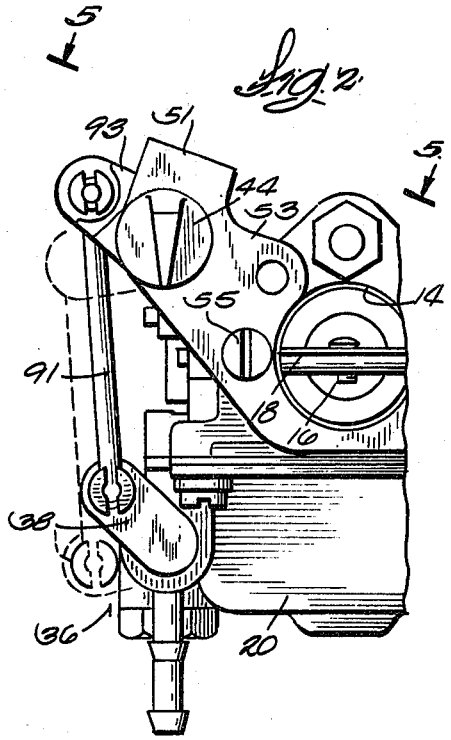
FIG. 2 is a fragmentary view of the left end of the carburetor shown in FIG. 1.

Before explaining the embodiments of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a carburetor 10 which includes a housing 12 and an air induction passage 14 extending through the housing 12. A throttle valve 16 and a choke valve 18 are carried for pivotal movement in the air induction passage 14. In particular, the choke valve 18 is movable between a fully opened position (shown as phantom line position in FIG. 1) and a fully closed position (shown as phantom line position in FIG. 4).

The carburetor 10 also includes a fuel or float chamber 20 which communicates with a source of fuel (not shown) as well as with the air induction passage 14, typically through a fuel metering orifice 22. A fuel pump 24 (see FIG. 1) pumps fuel from the source into the float chamber 20.

While various constructions are possible, in the illustrated embodiment the fuel pump 24 is a pulse-activated type, including a fuel chamber 26 in which a flexible bladder 28 is located. The bladder 28 communicates with a source of pulsating pressure variations, such as those occurring in an engine crankcase during piston reciprocation. As a result, the bladder 28 pulsates to change the volume of the chamber 26. Check valves 30 are provided at the inlet and outlet ends 32 and 34 of the fuel chamber 26 to channel the fuel in a single direction from the source into the carburetor float chamber 20 in response to bladder pulsation.

A fuel inlet valve 36 is located upstream of the inlet end 32 of the fuel pump 24 to control the introduction of fuel into the float chamber 20. While various constructions are possible, in the illustrated embodiment (see FIG. 1), the fuel inlet valve 36 is operable between rotationally spaced off and on positions to respectively block and permit the flow of fuel through the pump 24.

More particularly, in the illustrated embodiment, the fuel inlet valve 36 includes a rotary spool or valve member 38 which carries a diagonal O-ring 40 or the like. When the valve 36 is in its off position (as shown in in FIG. 1), the spool or valve member 38 is located so that the O-ring 40 blocks communication between the source and the fuel pump 24. When the valve 36 is in its on position, the spool member 38 is located so that the O-ring 40 affords communication between the source and the fuel pump 24.

A control rod or member 42 having a handle end 44 is provided to control the operative positions of both the choke valve 18 and the fuel inlet valve 36. While various constructions are possible, the control rod 42 has an axis 46 and is mounted on the carburetor housing 12 for movement both axially along and rotationally about its axis 46. In the illustrated embodiment, the axis 46 extends parallel to the axis of rotation of the fuel inlet valve 36 and perpendicularly to the axis of rotation of the choke valve 18. More particularly, the rod 42 is carried by a U-shaped support bracket 51 having one end or leg 53 fixed to the carburetor body by suitable means, such as the screws 55.

Linkage means 61 operatively connects the control rod 42 with the choke valve 18 and the fuel inlet valve 36 for operating the choke valve 18 in response to axial movement of the control rod 42 and for operating the fuel inlet valve 36 in response to rotational movement of the control knob 44.

Reference is made first to the operation of the choke valve 18 as controlled by axial movement of the control rod 42. In the illustrated embodiment, the control rod 42 is movable between a first or choke open position (shown in full lines in FIG. 1) and an axially spaced second or choke closed position (shown in FIG. 4).

In connection with control of the choke valve 18, the linkage means 61 includes a choke control link 63 which is carried on the control rod 42 for common axial movement therewith and for rotation relative therebetween. In this last regard, the link 63 includes a main body or part in the form of a ring part 65 which, during assembly, is axially slidable onto the control rod 42.

Figure 6:
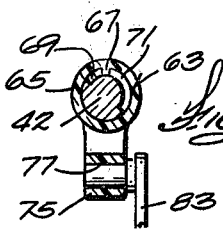
FIG. 6 is a fragmentary sectional view taken generally along line 6—6 of FIG. 4.

Means are provided on the control rod 42 and on the link 63 for permitting rotary movement therebetween while preventing axial movement. While various arrangements can be employed, in the illustrated construction, the ring part 65 of the link 63 includes, as shown in FIG. 6, an inwardly and axially extending rib or key 67 and the control rod or shaft 42 includes an axially extending slot or groove 69 which extends from the end of the control rod 42 shown to the left in FIG. 1, and which receives the rib 67 to permit axial movement on the control shaft 42 of the link 63 to the proper axial position, together with provision, intermediate the ends of the axial groove 69, of a circumferential groove 71 which extends from the axial groove 69 and which accepts the rib 67 to thereby permit rotary relative movement between the control rod or shaft 42 and the link 63. The ends of the rib 67 abut the side walls of the circumferential groove 71 to prevent relative axial movement. The operating range of relative rotary movement between the link 63 and the control rod 42 retains the key or rib 67 in the circumferential groove 71 and prevents re-alignment of the rib 67 with the axial groove 69 after full assembly.

The choke link control 63 also integrally includes an end part 75 having therein an aperature 77 and a resilent connecting part 79 which integrally joins the ring part 65 and the end part 75. The connecting part 79, as shown, is generally of U-shape, having one end connected to the end part 75 and one end connected to the ring part 65.

The ring part 65 also includes two parallel and spaced ribs 81 which extend outwardly so as to encompass at least a portion of the end part 75 to limit movement thereof in response to flexure of the connecting part 79.

The linkage means 61 also includes a rigid arm 83 which extends fixedly and radially from the choke valve shaft 85 and which includes, at the outer end thereof, a pin 87 which is received in the aperture 77 in the link end part 75 so that axial movement of the choke control link 63 with the control rod or shaft 42 causes rocking movement of the arm 83 and choke valve 18 between the choke open and choke closed positions. The pin 87 has an axial length sufficient to prevent disassembly thereof from the aperture 77.

Means are provided for limiting axial movement of the control rod 42 relative to the support bracket 51 and connected carburetor 10. While various arrangements can be employed, in the illustrated construction, such means comprises interference between the choke valve 18 and its mounting on the carburetor 10, which interference establishes the choke open and choke closed conditions.

Figure 3:
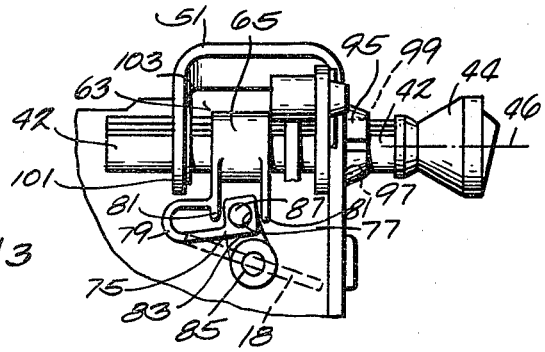
FIG. 3 is a fragmentary view of a portion of the carburetor shown in FIG. 1 with the components shown in another condition.
Figure 5:
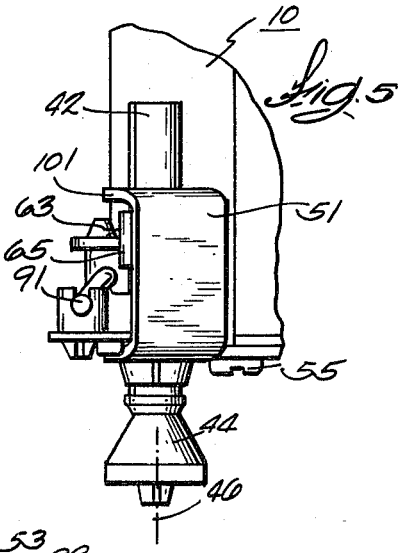
FIG. 5 is a fragmentary view taken generally along line 5—5 of FIG. 2.

The resilent nature of the connecting part 79 of the choke control link 63 serves to provide an over-center action biasing the choke valve 18 and control rod 42 toward either the choke open or choke closed positions from an intermediate position shown in FIG. 3.

Figure 4:
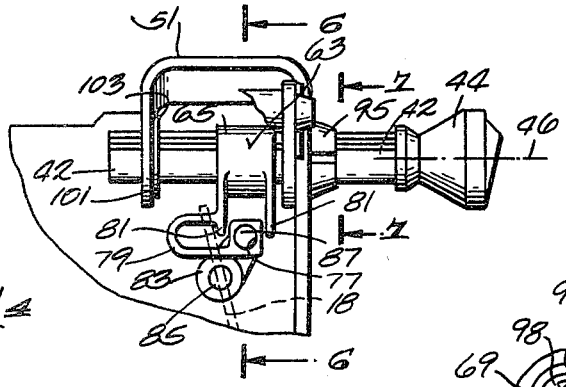
FIG. 4 is a fragmentary view similar to FIG. 3 showing the components in still another position.
Figure 7:
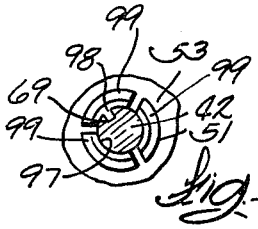
FIG. 7 is a fragmentary sectional view taken generally along line 7—7 of FIG. 4.

In particular, the resilient connecting part 79 is unflexed and unstressed when the control rod 42 and choke valve 18 are in the choke open and closed positions shown respectively in FIGS. 1 and 4. However, movement from either position to the other causes flexure or stressing of the resilient connecting part, as shown in FIG. 3, to a position of maximum flexure and stress at a point intermediate the choke open and choke closed positions. Thus the control rod 42 will be biased toward one of the choke open or choke closed positions depending upon location of the control rod 42 relative to the condition of maximum flexure (or stress) of the connecting part 79 of the link 63.

Preferably the choke control link 63 is fabricated of resilent plastic and the connecting part 79 is of relatively thin cross section affording flexure, while the ring part 65 and end part 75 are relatively bulky and therefor relatively rigid.

In connection with control of the fuel inlet valve 36, the valve member 38 thereof is pivotally connected to a connecting or fuel control link 91. In turn, the fuel control link 91 is pivotally connected to one end of an arm or lever 93 having, at the other end, an enlarged end part or hub 95 with a bore 97 which, in the fully assembled condition, receives and supports the control rod 42 for axial movement. The bore is provided with an inwardly extending key 98 received in the axial slot or groove 69 in the control rod 42 to provide for rotary movement of the lever 93 in common with the control rod 42, while also permitting axial movement of the control rod 42 relative to the lever 93.

Axial movement of the lever 93 in common with the control rod 42 is prevented by assembling the lever 93 to the support bracket leg 53 for pivotal movement relative thereto. In this regard, the hub 95 is formed with an outer surface engaged in an aperature formed in the support bracket leg 53 in co-axial relation to the axis 46 of the control rod 42. In addition, means are provided for preventing disassembly of the hub 95 from the support bracket leg 53. While various arrangements can be employed, in the illustrated construction, the lever 93 is fabricated of resilient plastic and the hub 95 includes a plurality of spaced retaining fingers 99 which can be collapsed inwardly into the bore 97 in the absence of the insertion of the control rod 42 to permit insertion of the fingers through the aperture in the support bracket leg 53, after which the fingers 99 expand to engage the far side of the support bracket leg 53 so as to prevent axial movement of the lever 93 and to afford re-establishment of the original diameter of the bore 97 so as thereby to provide a bearing which receives the control rod 42 during further assembly of the device.

The other leg 101 of the support bracket 51 is provided with a bushing 103 which receives another part of the control shaft or rod 42 so as to permit axial and rotary movement thereof. It is noted particularly that the choke control link 63 and the lever 93 are located on the control shaft or rod 42 between the legs 53 and 101 of the support bracket 51.

Various arrangements can be provided for limiting rotary movement of the control rod 42 and valve member 38. In the disclosed construction, the support bracket 51 and the hub 95 of the lever 93 include interengaging parts (not shown) limiting such rotary movement.

As a consequence of the foregoing construction, the control rod 42 can be moved axially to selectively locate the choke valve 18 in the choke open and choke closed positions and can be moved rotationally, when in any axial position, to selectively open and close the fuel inlet valve 36.

The disclosed construction is believed to provide an especially economical and compact arrangement. In addition, as the choke control link 63 is connected to the control shaft or rod 42 and fastened directly to the choke shaft 85, a shorter choke operating stroke is provided.

Various of the features of the invention are set forth in the following claims.

I claim:

1. A carburetor comprising a body including means defining an air induction passage, a choke valve pivotally supported by said body in said air induction passage for movement about an axis between choke open and choke closed positions, a fuel chamber, a fuel inlet valve selectively operable for controlling introduction of fuel from a source into said fuel chamber, a control member supported by said body, having an axis, and operative for movement axially along and rotationally about said axis, and linkage means operatively connecting said control member with said choke valve and said fuel inlet valve for operating said choke valve in response to axial movement of said control member between choke open and choke closed positions and for operating said fuel inlet valve in response to rotational movement of said control member, said linkage means including a rigid arm extending fixedly from said choke valve and radially of the axis of choke valve pivotal movement and a choke control link integrally including a body part on said control member, an end part pivotally connected to said arm, and an intermediate resilient connecting part joining said body part and said end part, and means on said control member and on said body part for permitting relative pivotal movement between said choke control link and said control member and for providing movement of said choke control link in common with axial movement of said control member.

2. A carburetor in accordance with claim 1 wherein said linkage means and said choke valve are arranged such that said resilient connecting part is in relatively relaxed positions when said control member and said choke valve are in said choke open and choke closed positions and in a flexed position spaced from said relaxed positions so as to bias said control member and said choke valve toward one of said choke open and choke closed positions when said control member is located intermediate said choke open and choke closed positions.

3. A carburetor in accordance with claim 1 and further including a control member support on said carburetor body, and wherein said fuel inlet means includes a rotatable valve member, and wherein said linkage means includes a lever having therein, at one end, an aperture having an axis, means mounting said lever on said support for pivotal movement therebetween about said aperture axis and against movement of said lever axially away from said support and with said control member extending through said aperture, and means on said control member and on said lever for effecting common pivotal movement of said lever with said control member and for permitting relative axial movement therebetween, and a fuel control link operatively connecting said lever to said valve member for pivoting said valve member in response to pivoting of said control member.

4. A carburetor in accordance with claim 3 wherein said linkage means includes means limiting the range of said pivotal movement of said control member.

5. A carburetor in accordance with claim 4 wherein said means for limiting the range of pivotal movement of said control member comprises interengaging means on said support and on said lever.

6. A carburetor in accordance with claim 3 wherein said support is U-shaped having first and second spaced legs, said first leg forming a part of said means mounting said lever and said second leg including aperture means slideably and rotatably supporting said control member in spaced relation from the support of said control member afforded by said lever and said first leg, and wherein said choke control link is located on said control member intermediate said first and second legs of said support.

7. A carburetor in accordance with claim 1 wherein said control member comprises a shaft having an end and an axial groove extending from said end and a circumferential groove extending from said axial groove, and wherein said means permitting relative pivotal movement between said choke control link and said control member and for providing movement of said choke control link in common with axial movement of said control member comprises said circumferential groove and a key extending from said body part of said choke control link into said circumferential groove.

8. A carburetor in accordance with claim 7 wherein said key and said axial groove have dimensions permitting receipt thereof in said axial groove for passage along said axial groove and into said circumferential groove.

9. A carburetor in accordance with claim 7 wherein said means on said lever and on said control member providing common pivotal movement of said lever and said control member and axial movement of said control member relative to said lever comprises said axial groove in said shaft and a key extending inwardly from said lever and received in said groove.

10. A carburetor comprising a body including means defining an air induction passage, a choke valve pivotally supported by said body in said air induction passage for movement about an axis between choke open and choke closed positions, a fuel chamber, a selectively operable fuel inlet valve for controlling introduction of fuel from a source into said fuel chamber and including a rotatable valve member, a U-shaped support on said body and including first and second spaced legs, a control member having an axis and mounted by said first and second legs of said support for movement axially of and rotationally about said axis, said control member having an end and an axial groove extending from said end and a circumferential groove extending from said axial groove, a rigid arm extending fixedly from said choke valve and radially of the axis of choke valve pivotal movement, a choke control link integrally including a body part supported on said control member intermediate said first and second legs, an end part pivotally connected to said arm, and an intermediate resilient connecting part joining said body part and said end part, said resilient connecting part being in relatively relaxed positions when said control member and said choke valve are in said choke open and choke closed positions and in a flexed position spaced from said relaxed positions so as to bias said control member and said choke valve toward one of said choke open and choke closed positions when said control member is located intermediate said choke open and choke closed positions, means on said control member and said body part for permitting relative pivotal movement between said choke control link and said control member and for providing movement of said choke control link in common with axial movement of said control member comprising said circumferential groove and a key extending from said body part of said choke control link into said groove, said key having dimensions permitting receipt thereof in said axial groove for passage along said axial groove and into said circumferential groove, a lever having therein, at one end, an aperture, means mounting said lever on said first leg of said support for pivotal movement therebetween about an axis coincident with said control member axis and against movement of said lever axially away from said support, and with said control member extending through said aperture, means on said control member and on said lever effecting common pivotal movement of said lever with said control member and for permitting relative axial movement therebetween comprising said axial groove in said shaft and a second key extending inwardly from said lever and received in said groove, a fuel control link operatively connecting said lever to said valve member for pivoting said valve member in response to pivoting of said control member, and means limiting the range of said pivotal movement of said control member comprising interengaging means on said support and on said lever.

* * * * *